US007845285B2

(12) United States Patent
Hast

(10) Patent No.: US 7,845,285 B2
(45) Date of Patent: Dec. 7, 2010

(54) RAIL FOR SELF-PROPELLED ELECTRIC TRUCKS

(75) Inventor: Michael Hast, Ebersberg (DE)

(73) Assignee: Swisslog Telelift GmbH (DE)

( * ) Notice: Subject to any disclaimer, the term of this patent is extended or adjusted under 35 U.S.C. 154(b) by 0 days.

(21) Appl. No.: 12/085,244

(22) PCT Filed: Nov. 23, 2005

(86) PCT No.: PCT/EP2005/012538

§ 371 (c)(1),
(2), (4) Date: May 19, 2008

(87) PCT Pub. No.: WO2007/059785

PCT Pub. Date: May 31, 2007

(65) Prior Publication Data

US 2009/0064891 A1 Mar. 12, 2009

(51) Int. Cl.
*B61B 5/02* (2006.01)
*E01B 25/24* (2006.01)

(52) U.S. Cl. ..... 104/107; 238/176; 104/108; 104/109

(58) Field of Classification Search ..... 104/89, 104/94, 95, 107–109; 105/154, 155; 191/32, 191/22 C; 238/264, 176
See application file for complete search history.

(56) References Cited

U.S. PATENT DOCUMENTS

| | | | | |
|---|---|---|---|---|
| 2,254,147 | A * | 8/1941 | Horn | 191/23 A |
| 3,236,192 | A * | 2/1966 | Esquillan | 104/94 |
| 3,340,821 | A | 9/1967 | Wesener | |
| 3,341,670 | A * | 9/1967 | Martin et al. | 191/32 |
| 3,502,038 | A | 3/1970 | Wesener | |
| 3,636,883 | A | 1/1972 | Wesener | |
| 3,800,707 | A * | 4/1974 | Hermann | 104/94 |
| 3,942,449 | A | 3/1976 | Nelson | |
| 4,043,436 | A * | 8/1977 | Segar et al. | 191/32 |
| 4,893,566 | A | 1/1990 | Fukuda | |
| 5,104,040 | A * | 4/1992 | Bormann et al. | 238/151 |
| 5,735,217 | A | 4/1998 | Halbig et al. | |
| 6,058,849 | A * | 5/2000 | Ostholt et al. | 104/93 |
| 6,202,566 | B1 * | 3/2001 | Hutchinson | 105/148 |
| 6,324,988 | B1 * | 12/2001 | Svensson | 104/89 |
| 7,584,703 | B2 * | 9/2009 | Wallner | 104/106 |

FOREIGN PATENT DOCUMENTS

| | | |
|---|---|---|
| CH | 515819 A | 1/1972 |
| FR | 1 302 609 | 8/1962 |
| GB | 930435 | 7/1963 |
| WO | WO 95/14599 | 6/1995 |

* cited by examiner

*Primary Examiner*—S. Joseph Morano
*Assistant Examiner*—Zachary Kuhfuss
(74) *Attorney, Agent, or Firm*—George Pappas

(57) ABSTRACT

Rail for self-propelled electric trucks, with the rail (2) having a base part (6) and C-shaped side flanks (8, 10) which engage over side wheels (12) of the truck (4). In order to improve the rail, each C-shaped side flank (8, 10) has a central running area (14), which is offset outwards, for side guide rollers (16) of the truck (4) and upper and lower supporting services (18, 20) which run at an angle to the wheel (12) for the side wheels (12), with the running area (14) and the supporting areas (18, 20) being used alternately.

8 Claims, 6 Drawing Sheets

RAIL FOR SELF-PROPELLED ELECTRIC TRUCKS

This application claims priority of PCT application PCT/EP2005/012538 having a priority date of Nov. 23, 2005, the disclosure of which is incorporated herein by reference.

TECHNICAL FIELD

The invention concerns a rail for a self-propelled electric trolley.

BACKGROUND OF THE INVENTION

Rails of the type mentioned above are known from many examples.

CH 515 819 describes such a rail in which the C-shaped sides of the rails engage the side wheels of the trolley. The wheels in turn run on the upper or lower edges of the C-shaped sides. For lateral support, radially projecting support rims, which function in concert with the side parts of the sides of the rail, are provided along the circumferential running surfaces of the trolley wheels on the side facing away from the sides. Because they can be easily damaged, the support rims make the trolley wheels relatively complicated and vulnerable. The support rims may also cause damage to a surface on which the trolley is placed outside the rail. Finally, the rail is also relatively complicated, because it requires a ledge on which the support rims can be supported laterally to be present between the sides and the base part of the rail. In overhead suspension operation, the support rim exerts force on the outer edge of the sides, making it necessary for these parts to be of thick construction to prevent bending. They therefore require a relatively high amount of material and are thus costly.

WO95/14599 presents an improved rail in which the C-shaped sides connect evenly to the base part and no ledges are necessary. For the trolley wheels, the support rims are replaced by lateral guide wheels within the wheels, which abut the center of the sides. Because the guide wheels engage the center of the sides, less supporting force needs to be exerted by the sides and the rails can therefore be of lighter construction as a result of the supporting forces acting at a lower level. However, this rail may only be used by trolleys with lateral guide rollers.

SUMMARY OF THE INVENTION

The object of the invention is to create a novel type of rail, which allows mixed operation of trolleys with and without lateral guiding rollers.

If each C-shaped side features a central, outwardly displaced running area for the lateral guide rollers of the trolley and upper and lower support surfaces for the side wheel inclined towards the wheel, where the running areas and the support surfaces areas are used in alternation, then the rail can be used by both trolleys with simple wheels without support rims and by trolleys with lateral guide rollers. The simple wheels rest on the lower support surfaces when the trolley is driven on a normal level, or on the upper support surfaces when the trolley is driven suspended overhead. On trolleys with lateral guide rollers, these rollers abut the middle running area of the C-shaped sides of the rails. The novel rail thus facilitates mixed operation by both types of vehicles.

The special profiling of the C-shaped sides of the rails reduces the bending of the sides when overhead suspension is employed. Less material is required to construct the rail, while at the same time the trolley can be loaded more heavily.

The space gained through the upper guide bevel of the side can be used for integrating the assembly grooves.

Advantageous configurations of the rails are detailed in the following exemplary embodiments.

BRIEF DESCRIPTION OF THE DRAWINGS

The exemplary embodiments of the invention are described in greater detail with reference to the drawings, wherein.

DETAILED DESCRIPTION OF THE PREFERRED EMBODIMENTS

Figure 1:
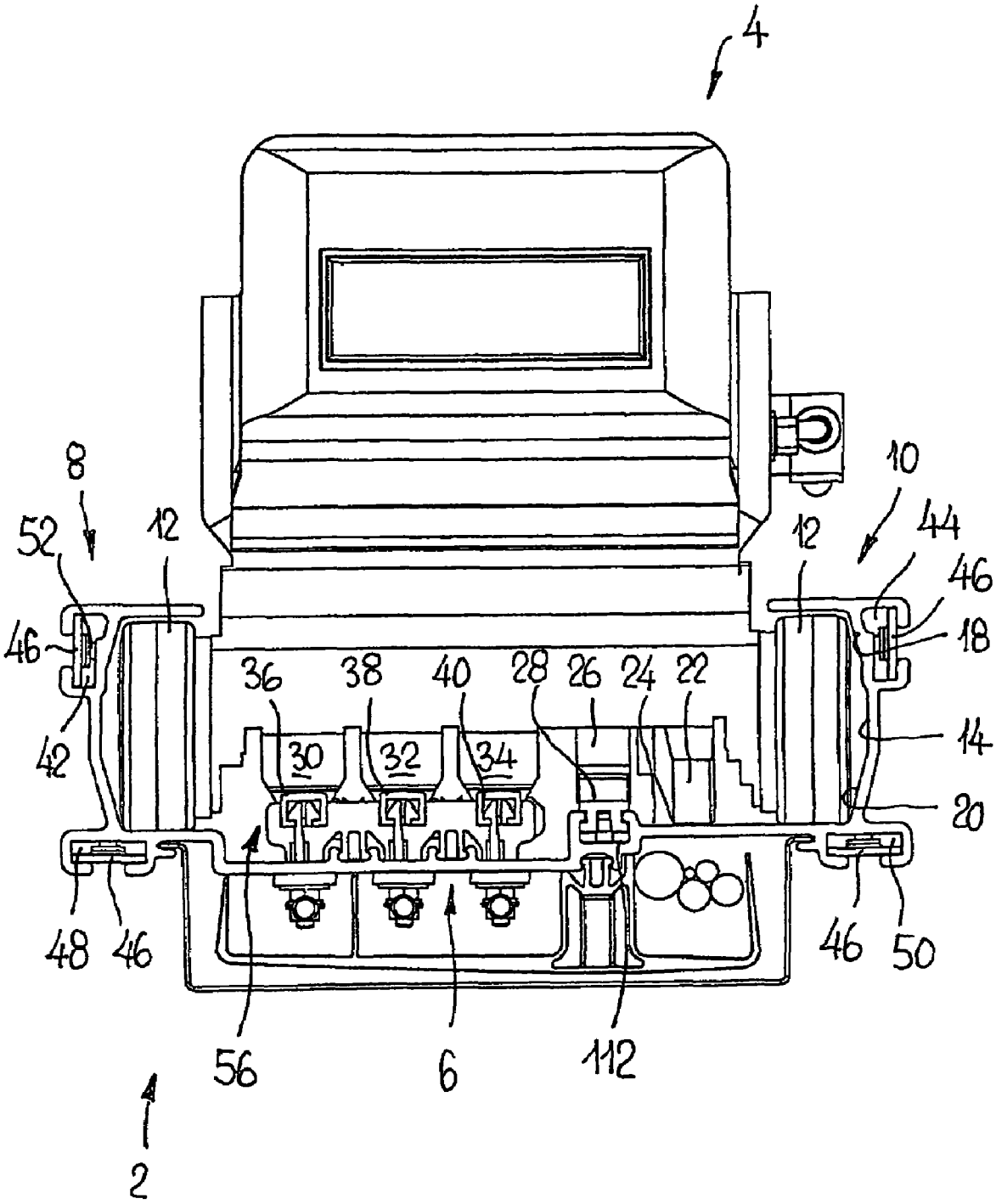
FIG. 1 A rail with a trolley without lateral guide rollers, frontal view.
Figure 2:
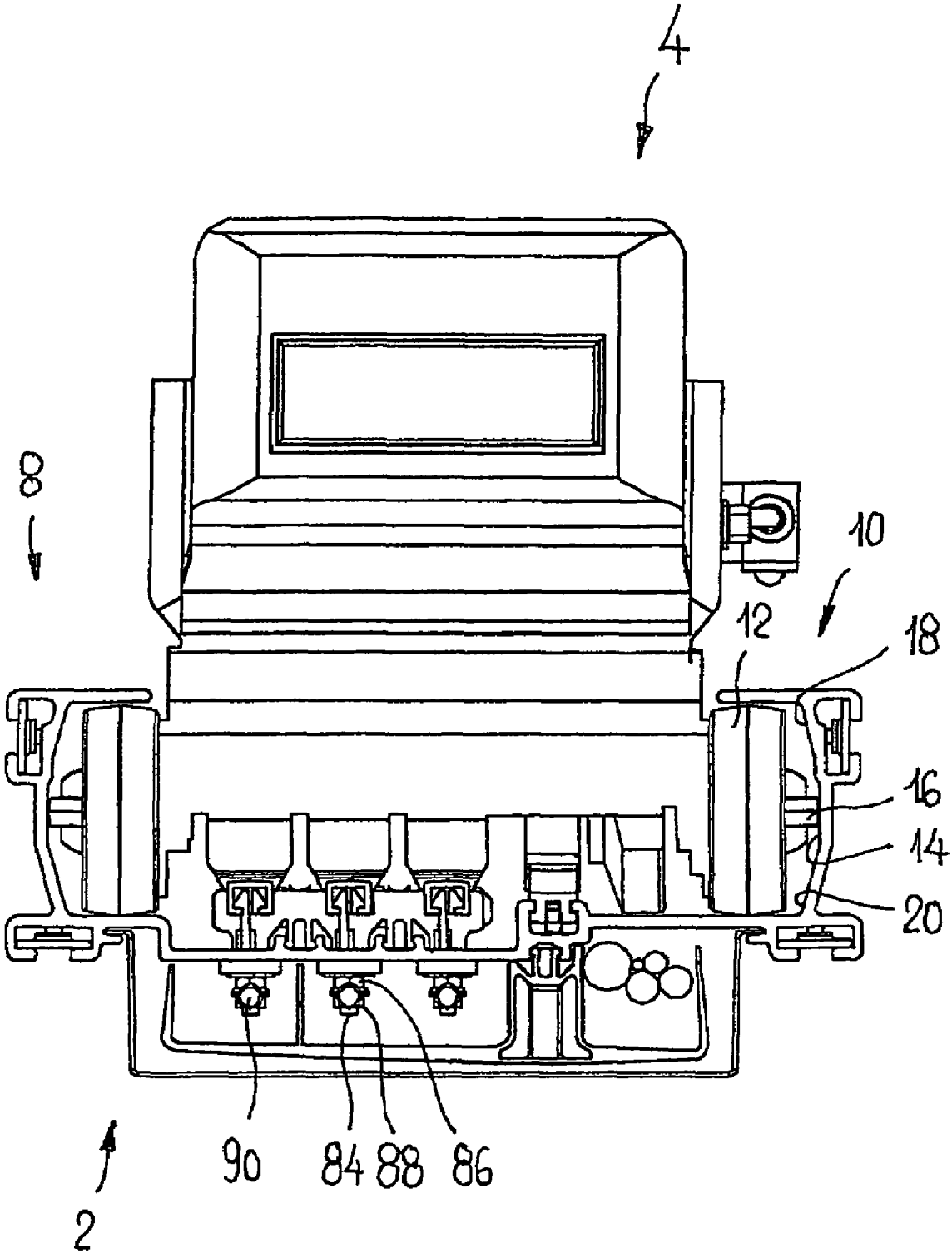
FIG. 2 A rail with a trolley with lateral guide rollers, frontal view
Figure 3:
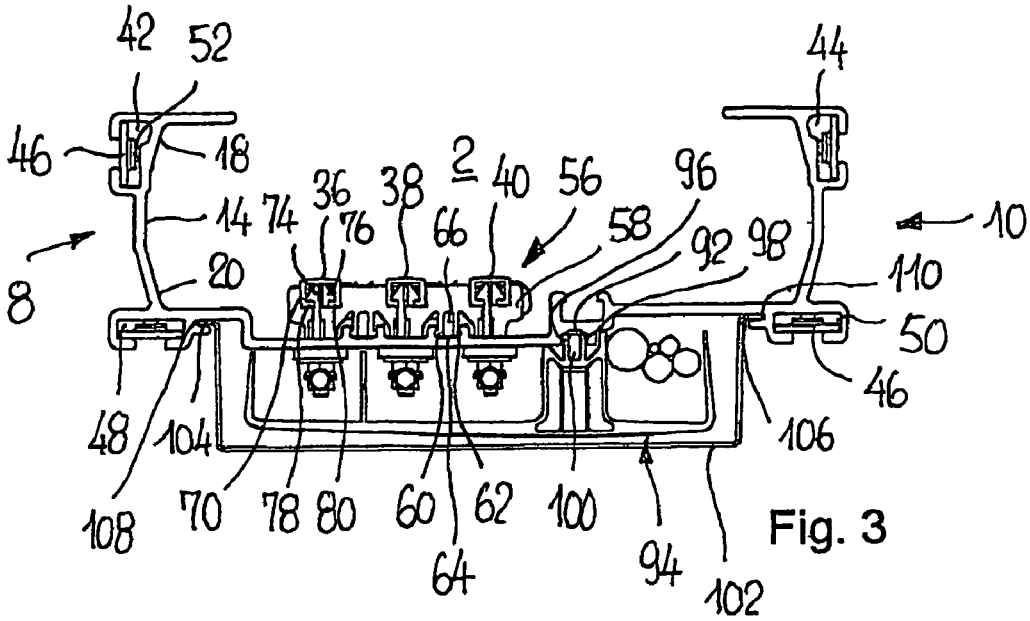
FIG. 3 The rail shown in FIGS. 1 and 2 without trolley.
Figure 4:
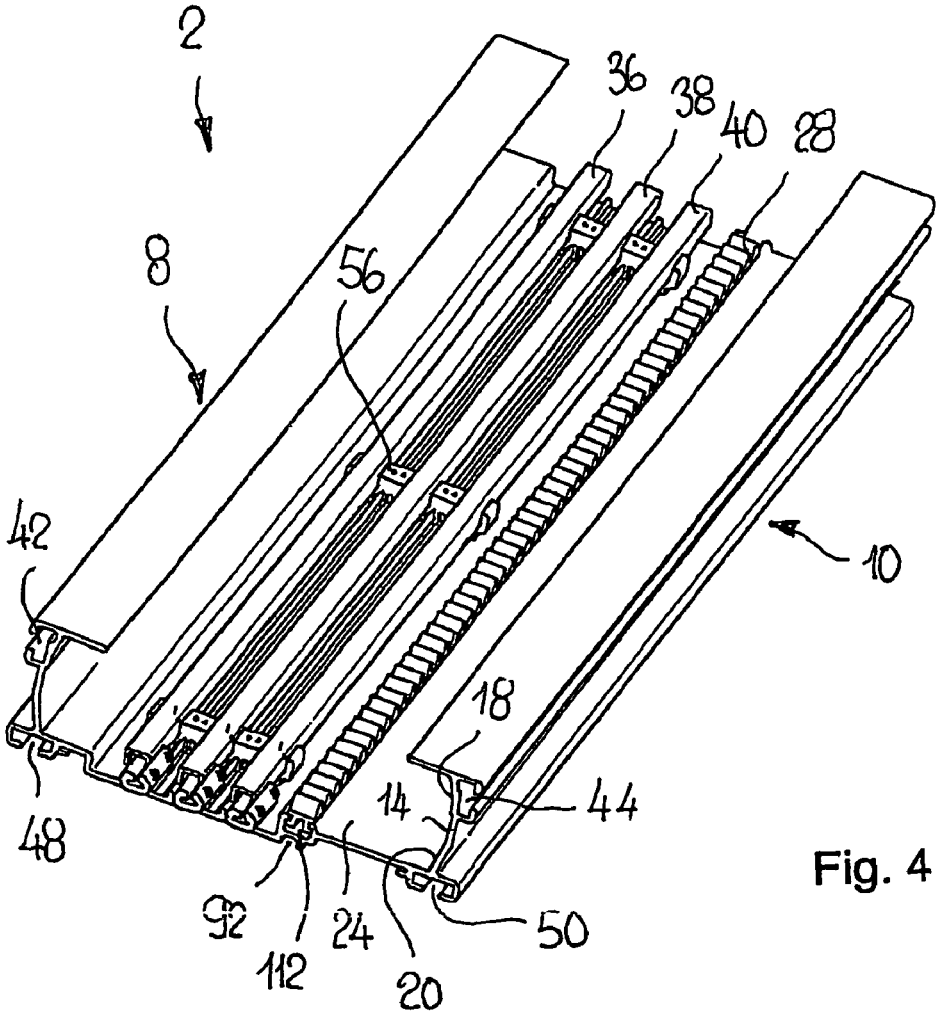
FIG. 4 Diagrammatic illustration of the rail shown in FIG. 3.

FIGS. 1 and 2 show a cross section of a segment of a conveyor system that features rails 2 in which a self-propelled trolley 4 is arranged. One such rail 2 features a base part 6 and C-shaped sides 8, 10, which enclose the side wheels 12 of the trolley 4. The C-shaped sides 8, 10 each feature a central, outwardly displaced running area 14 for the lateral guide rollers 16 of the trolley, as well as upper and lower support surfaces 18, 20, each inclined towards the wheel 12. One and the same rail is thus suited for trolleys 4 that feature lateral guide rollers 16, as shown in FIG. 2, and for trolleys 4 without lateral guide rollers, but on which the wheels 12 simply abut the support surfaces 18, 20.

The wheels 12 and the guide rollers 16 are generally non-powered wheels or rollers without any drive function. Drive is provided on the one hand by a frictional wheel 22 functioning in concert with a corresponding frictional surface 24 of the rail 2, and/or a cog 26 functioning together with a cog rail 28 of the rail 2. Sliding contacts 30, 32, 34 function together with power rails 36, 38, 40 in the rail and serve to transmit current on the one hand and provide switching and control functions on the other hand.

The details of the rail and its function are illustrated in greater detail in FIGS. 3 through 13 and are further described below.

Figure 5:
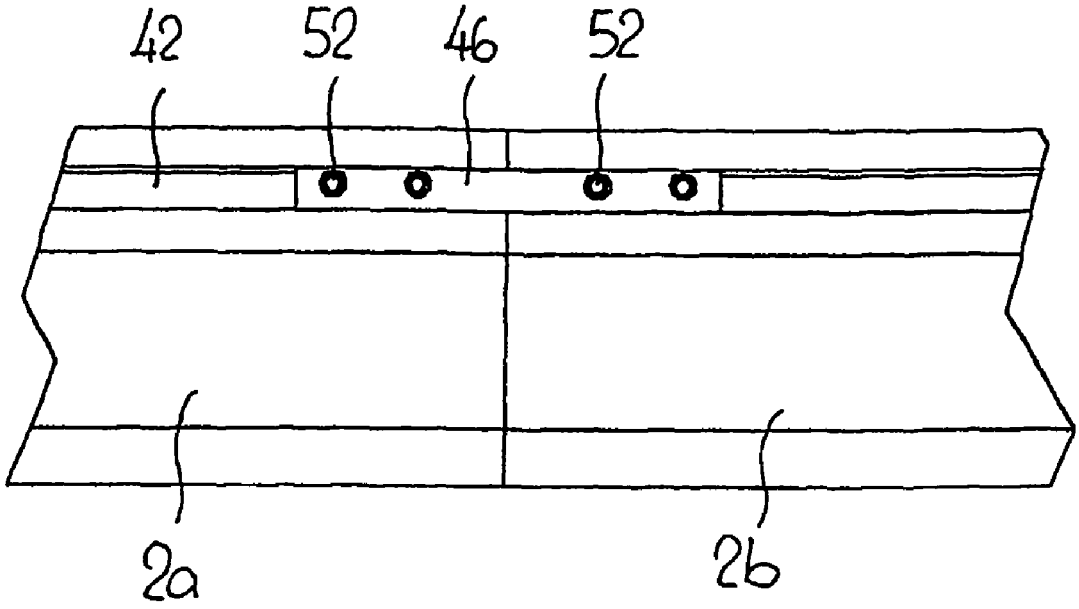
FIG. 5 Side view of the connection between two rail segments.
Figure 6:
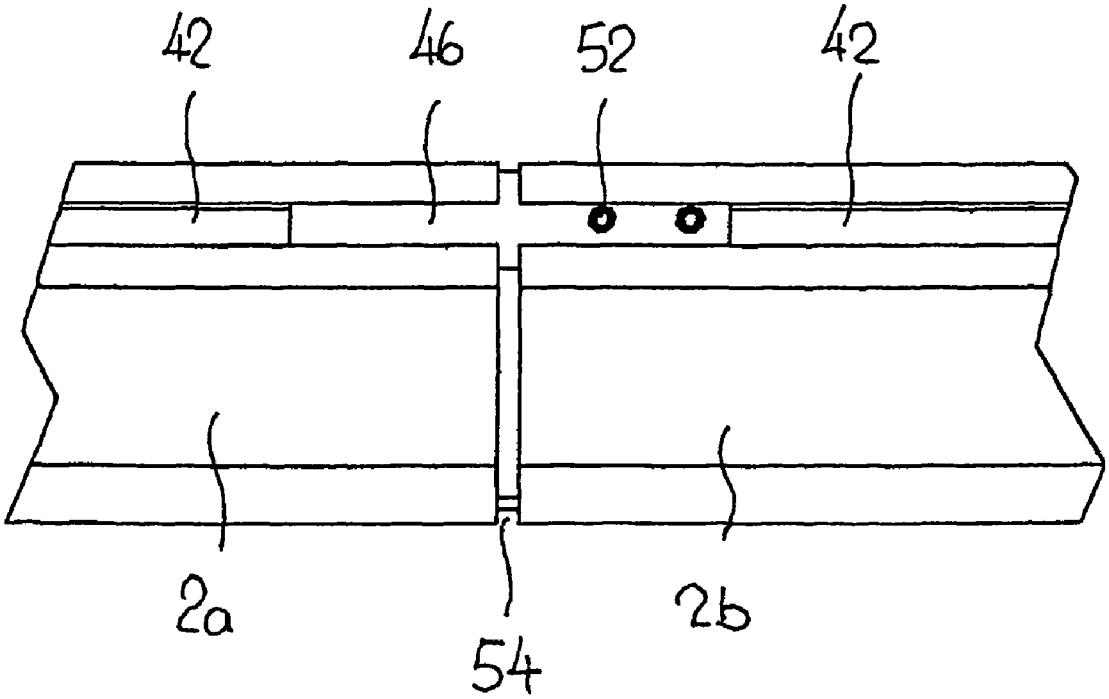
FIG. 6 Side view of the connection between two rail segments with expansion joint.

In the respective upper portion of the C-shaped sides 8, 10, the rail 2 features dovetailed assembly grooves 42, 44, which accommodate the clampable connection strips 46 for connecting adjoining rail segments 2*a*, 2*b* to one another. Additional assembly grooves 48, 50 for accommodating connection strips 46 are arranged on the bottom side of the base part 6 of the rail 2. To provide a secure connection between adjoining rail sections 2*a*, 2*b*, the connection strips 46 feature clamping screws 52 for each rail section 2*a*, 2*b* as FIG. 5 illustrates. To create an expansion joint 54 between segments 2*a*, 2*b*, the connection strips 46 are fastened to only one rail segment 2*b* by means of clamping screws 52, while the connection strip 46 is displaceably arranged in the other rail segment 2*a* as FIG. 6 shows.

Figure 7:
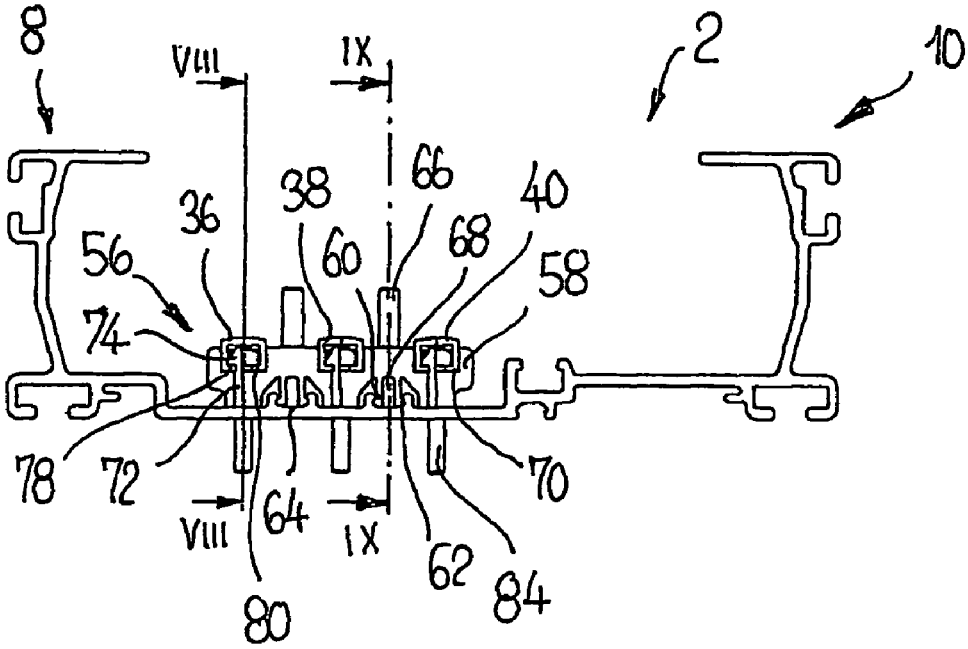
FIG. 7 The rail shown in FIG. 3 only with power rails.
Figure 8:
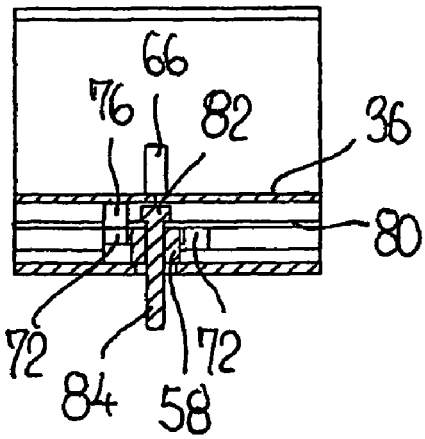
FIG. 8 The rail shown in FIG. 7 in section VIII-VIII from FIG. 7.
Figure 9:
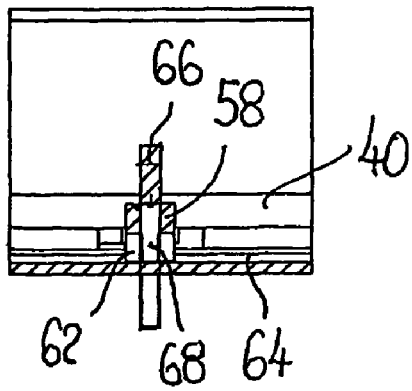
FIG. 9 The rail shown in FIG. 7 in section IX-IX from FIG. 7.

The power rails 36, 38, 40 are fastened with the aid of sliders 56, which feature a block part 58 with molded feet 60, 62, which engage the dovetailed assembly grooves 64 of the rails 2. Driven dowel pins 66 between the feet 60, 62 prevent the sliders 56 from separating from the base part 6. In FIGS. 7 and 9, the dowel pins 66 are shown prior to being driven into the opening 68 between the feet 60, 62. Recesses 70 for accommodating the power rails 36, 38, 40 are arranged in the block part 58. Lateral to the block part 58 are snap-in pins 72, which feature snap-in hooks 74, 76 oriented away from one another, which function together with facing snap-in strips 78, 80 of the hollow power rails 36, 38, 40. To facilitate connection to a power supply, the heads 82 of contact screws 84 extending through the block part 58 of the slider 56 and the base part 6 of the rail 2 to the opposite side thereof are arranged in the power rails 36, 38, 40. As FIGS. 1 through 3 reflect, the contact screws 84 are secured by means of a first nut 86, while a second nut 88 serves for clamping the power supply connection 90.

Arranged on the bottom side of the base part 6 is an additional dovetailed assembly groove 92 for the purpose of fastening cable clips 94. The latter features clipping feet 96, 98, which engage the assembly groove 92 and between which a dowel pin 100 is arranged to prevent the feet from separating from the assembly groove 92. The cable clips 94 arranged at specific intervals on the bottom side of the base part 6 serve to hold all types of lines such as power supply lines and control lines. The bottom side of the base part 6 can also ultimately be covered with a cover 102 that features side fastening strips 104, 106 that engage corresponding insert grooves 108, 110 on the bottom side of the base part.

An additional dovetailed assembly groove 112 for securing the cog rail 28 is arranged on the top side of the base part 6.

Figure 10:
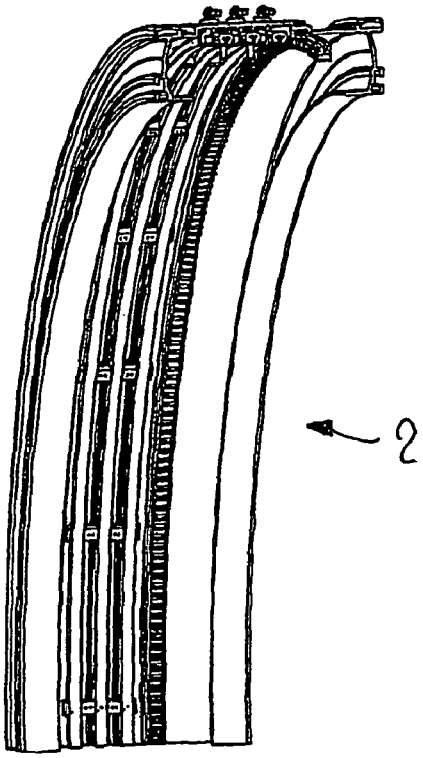
FIG. 10 Diagrammatic illustration of a concave rail segment.
Figure 11:
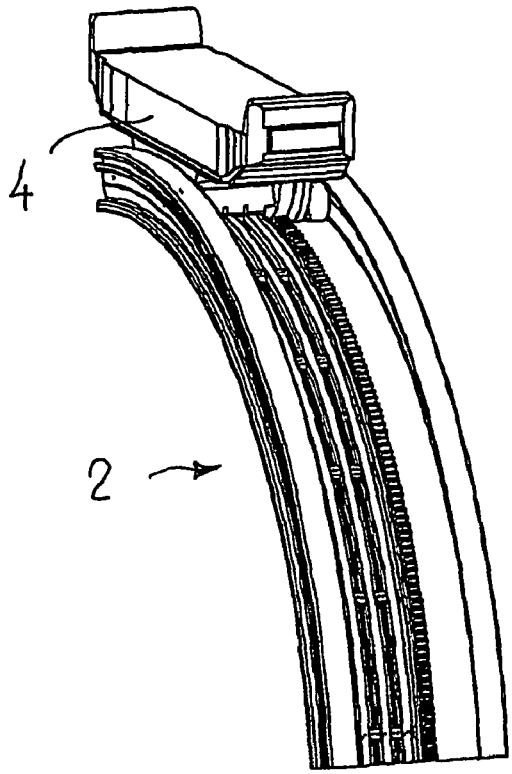
FIG. 11 Diagrammatic illustration of a convex rail segment.

A rail of this kind can be bent to form an inside curve as shown in FIG. 10 or an outside curve as shown in FIG. 11. For this purpose, the rail can be bent as a whole unit in the manner shown.

Figure 12:
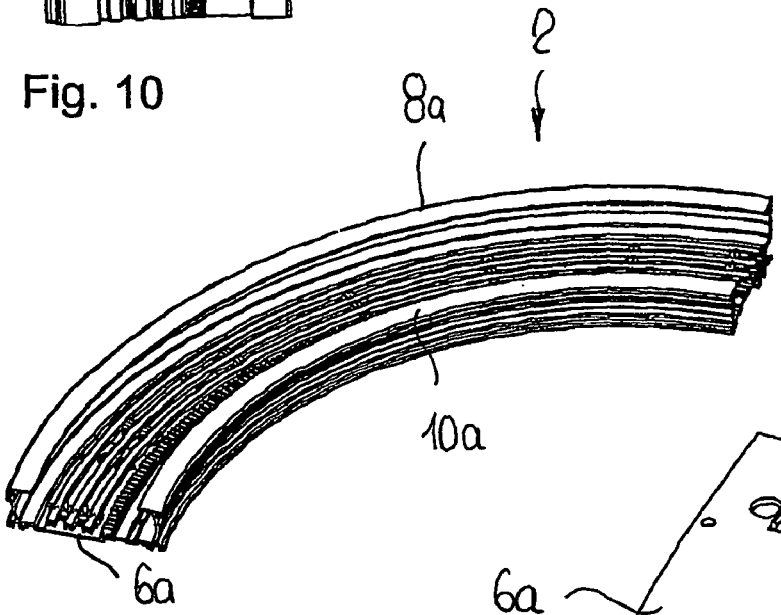
FIG. 12 Diagrammatic illustration of a laterally curved rail segment.
Figure 13:
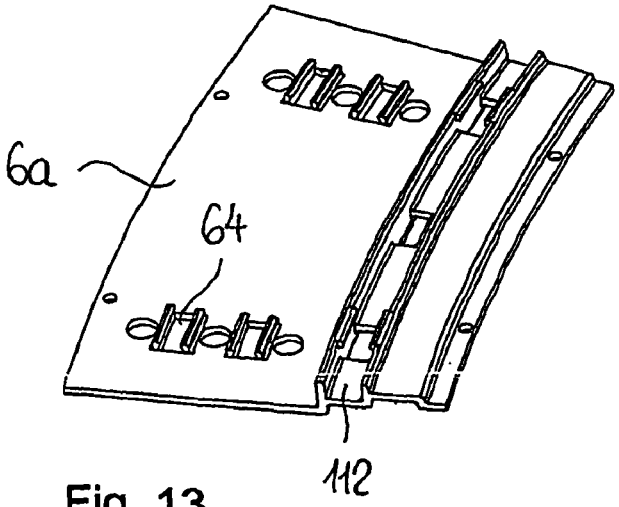
FIG. 13 A base segment part for connecting the sides of the rail shown in FIG. 12.

To form an inside or outside curve as shown in FIG. 12, the C-shaped sides 8*a* and 10*a* must be individually bent according to the desired curvature radius and then connected to one another using the base segment parts 6*a*.

The new rail is suited not only for mixed operation by trolleys with and without lateral guide rollers, but, thanks to the assembly grooves and the insert-and-clip connections, can be employed universally, is easy to retrofit, and can be assembled quickly and easily. Rails can be removed and later reused in a simple manner. No complicated tools are required.

| Reference number list | |
|---|---|
| 2 | Rail |
| 2a, 2b | Rail segment |
| 4 | Trolley |
| 6 | Base part |
| 6a | Base segment part |
| 8, 8a | C-shaped side |
| 10, 10a | C-shaped side |

-continued

| Reference number list | |
|---|---|
| 12 | Wheel |
| 14 | Running area |
| 16 | Guide roller |
| 18, 20 | Support surface |
| 22 | Frictional wheel |
| 24 | Frictional surface |
| 26 | Cog |
| 28 | Cog rail |
| 30, 32, 34 | Sliding contact |
| 36, 38, 40 | Power rail |
| 42 | Assembly groove on 8 |
| 44 | Assembly groove on 10 |
| 46 | Connection strip |
| 48 | Assembly groove on 6 |
| 50 | Assembly groove on 6 |
| 52 | Clamping screw |
| 54 | Expansion joint |
| 56 | Slider |
| 58 | Block part |
| 60, 62 | Foot |
| 64 | Assembly groove |
| 66 | Dowel pin |
| 68 | Opening |
| 70 | Recess |
| 72 | Snap-in pin |
| 74, 76 | Snap-in hook |
| 78, 80 | Snap-in strip |
| 82 | Head |
| 84 | Contact screw |
| 86 | First nut |
| 88 | Second nut |
| 90 | Power supply connection |
| 92 | Assembly groove |
| 94 | Cable clip |
| 96, 98 | Foot |
| 100 | Dowel pin |
| 102 | Cover |
| 104, 106 | Fastening strip |
| 108, 110 | Insert groove |
| 112 | Assembly groove for 28 |

The invention claimed is:

1. Rail for self-propelled electric trolley, whereby the rail features a base part and C-shaped sides, which enclose lateral wheels of the trolley, characterized in that each C-shaped side features a central, outwardly displaced running area for lateral guide rollers of the trolley as well as upper and lower lateral support surfaces for the lateral wheels, each inclined towards the wheel, so that one and the same rail is suitable for trolleys having lateral wheels with guiding rollers as well as without guiding rollers, wherein the outwardly displaced running area is operably engaged with lateral wheels having guiding rollers and the upper and lower lateral support surfaces are alternatively operably engaged with lateral wheels without guiding rollers; and whereby said rail features dovetailed assembly grooves for accommodating attachments on the inside of the base part, characterized in that it features multiple sliders arranged in intervals over the length of the rail and perpendicular to the rail, each of which features feet clipped into the assembly grooves with dowel pins driven between the feet.

2. Rail as in claim 1, characterized in that on the side facing away from the fastening side, each slider features recesses oriented with the rail for accommodating power rails.

3. Rail as in claim 2, characterized in that assigned to each recess are snap-in pins, which feature snap-in hooks oriented away from one another, which function together with facing snap-in strips of the hollow power rails.

4. Rail for self-propelled electric trolley, whereby the rail features a base part and C-shaped sides, which enclose lateral wheels of the trolley, characterized in that each C-shaped side features a central, outwardly displaced running area for lateral guide rollers of the trolley as well as upper and lower lateral support surfaces for the lateral wheels, each inclined towards the wheel, so that one and the same rail is suitable for trolleys having lateral wheels with guiding rollers as well as without guiding rollers, wherein the outwardly displaced running area is operably engaged with lateral wheels having guiding rollers and the upper and lower lateral support surfaces are alternatively operably engaged with lateral wheels without guiding rollers; and on the bottom side of the base part it features a dovetailed assembly groove in which the cable clips are installed by means of clippable feet, between which dowel pins are arranged.

5. Rail for self-propelled electric trolley, whereby the rail features a base part and C-shaped sides, which enclose lateral wheels of the trolley, characterized in that each C-shaped side features a central, outwardly displaced running area for lateral guide rollers of the trolley as well as upper and lower lateral support surfaces for the lateral wheels, each inclined towards the wheel, so that one and the same rail is suitable for trolleys having lateral wheels with guiding rollers as well as without guiding rollers, wherein the outwardly displaced running area is operably engaged with guiding rollers of lateral wheels and the upper and lower lateral support surfaces are alternatively operably engaged with lateral wheels without guiding rollers, and further wherein the outside of its profile features dovetailed assembly grooves for accommodating clampable connection strips for connecting neighboring rail segments, whereby said rail features dovetailed assembly grooves for accommodating attachments on the inside of the base part and it features multiple sliders arranged in intervals over the length of the rail and perpendicular to the rail, each of which features feet clipped into the assembly grooves with dowel pins driven between the feet.

6. Rail for self-propelled electric trolley, whereby the rail features a base part and C-shaped sides, which enclose lateral wheels of the trolley, characterized in that each C-shaped side features a central, outwardly displaced running area for lateral guide rollers of the trolley as well as upper and lower lateral support surfaces for the lateral wheels, each inclined towards the wheel, so that one and the same rail is suitable for trolleys having lateral wheels with guiding rollers as well as without guiding rollers, wherein the outwardly displaced running area is operably engaged with guiding rollers of lateral wheels and the upper and lower lateral support surfaces are alternatively operably engaged with lateral wheels without guiding rollers, and further wherein the outside of its profile features dovetailed assembly grooves for accommodating clampable connection strips for connecting neighboring rail segments, at least two assembly grooves are arranged on the base part, whereby said rail features dovetailed assembly grooves for accommodating attachments on the inside of the base part and it features multiple sliders arranged in intervals over the length of the rail and perpendicular to the rail, each of which features feet clipped into the assembly grooves with dowel pins driven between the feet.

7. Rail for self-propelled electric trolley, whereby the rail features a base part and C-shaped sides, which enclose lateral wheels of the trolley, characterized in that each C-shaped side features a central, outwardly displaced running area for lateral guide rollers of the trolley as well as upper and lower lateral support surfaces for the lateral wheels, each inclined towards the wheel, so that one and the same rail is suitable for trolleys having lateral wheels with guiding rollers as well as without guiding rollers, wherein the outwardly displaced running area is operably engaged with guiding rollers of lateral wheels and the upper and lower lateral support surfaces are alternatively operably engaged with lateral wheels without guiding rollers, and further wherein the outside of its profile features dovetailed assembly grooves for accommodating clampable connection strips for connecting neighboring rail segments, an assembly groove is arranged in each of the sides at a location distally spaced from the base and distal of the running area, whereby said rail features dovetailed assembly grooves for accommodating attachments on the inside of the base part and it features multiple sliders arranged in intervals over the length of the rail and perpendicular to the rail, each of which features feet clipped into the assembly grooves with dowel pins driven between the feet.

8. Rail for self-propelled electric trolley, whereby the rail features a base part and C-shaped sides, which enclose lateral wheels of the trolley, characterized in that each C-shaped side features a central, outwardly displaced running area for lateral guide rollers of the trolley as well as upper and lower lateral support surfaces for the lateral wheels, each inclined towards the wheel, so that one and the same rail is suitable for trolleys having lateral wheels with guiding rollers as well as without guiding rollers, wherein the outwardly displaced running area is operably engaged with guiding rollers of lateral wheels and the upper and lower lateral support surfaces are alternatively operably engaged with lateral wheels without guiding rollers, and further wherein the outside of its profile features dovetailed assembly grooves for accommodating clampable connection strips for connecting neighboring rail segments, to create an expansion joint between neighboring segments, the connection strip is clamped in only one rail segment and displaceably arranged in the other rail segment, whereby said rail features dovetailed assembly grooves for accommodating attachments on the inside of the base part and it features multiple sliders arranged in intervals over the length of the rail and perpendicular to the rail, each of which, features feet clipped into the assembly grooves with dowel pins driven between the feet.

* * * * *